United States Patent [19]

Eaton

[11] Patent Number: 4,658,503

[45] Date of Patent: Apr. 21, 1987

[54] METHOD AND APPARATUS FOR TERMINAL INSERTION

[75] Inventor: Homer L. Eaton, Leucadia, Calif.

[73] Assignee: MTS Vektronics Corporation, Carlsbad, Calif.

[21] Appl. No.: 646,949

[22] Filed: Sep. 4, 1984

[51] Int. Cl.[4] ..... H01R 43/00

[52] U.S. Cl. ..... 29/854; 29/837; 29/842; 29/857

[58] Field of Search ..... 29/854, 855, 857, 868, 29/869, 872, 747, 748, 750, 752, 754, 758, 837, 845, 876, 881, 882, 884, 271, 272, 742, 842

[56] References Cited

U.S. PATENT DOCUMENTS

| | | | |
|---|---|---|---|
| T101,002 | 9/1981 | Ellington, III | 29/747 |
| 3,023,789 | 3/1962 | Bonhomme | 29/754 X |
| 3,103,735 | 9/1963 | Bos et al. | 29/33 |
| 3,136,040 | 6/1964 | Bauer et al. | 29/203 |
| 3,185,183 | 5/1965 | Loy | 140/71 |
| 3,329,002 | 7/1967 | Schwalm | 72/416 |
| 3,456,324 | 7/1969 | Hahn et al. | 29/747 X |
| 3,513,526 | 5/1970 | Eastin | 29/203 |
| 3,605,234 | 11/1969 | Bogursky | 29/747 X |
| 3,789,484 | 2/1974 | Morgan | 29/747 |
| 3,811,168 | 5/1974 | Anderson et al. | 29/747 |
| 3,964,147 | 6/1976 | Fusco et al. | 29/203 B |
| 4,043,034 | 8/1977 | Sucheski et al. | 29/749 |
| 4,055,889 | 11/1977 | Fusco et al. | 29/710 |
| 4,074,424 | 2/1978 | Deshich et al. | 29/753 |
| 4,087,908 | 5/1978 | Fusco et al. | 29/753 |
| 4,089,405 | 5/1978 | Loomis et al. | 198/475 |
| 4,099,663 | 4/1978 | Brill et al. | 29/868 X |
| 4,164,065 | 8/1979 | Funcik et al. | 29/564.6 |
| 4,171,566 | 10/1979 | Tominoi | 29/748 |
| 4,247,980 | 2/1981 | Tominoi | 29/742 |
| 4,308,659 | 1/1982 | Brandewie et al. | 29/748 |
| 4,341,014 | 7/1982 | Loy et al. | 29/857 |
| 4,351,109 | 9/1982 | Kelly et al. | 29/747 |
| 4,395,818 | 8/1983 | Jackson | 29/747 |
| 4,404,743 | 9/1983 | Brandewie et al. | 29/857 |

FOREIGN PATENT DOCUMENTS

| | | | |
|---|---|---|---|
| 962044 | 2/1975 | Canada | 29/271 |

*Primary Examiner*—Howard N. Goldberg
*Assistant Examiner*—Joseph M. Gorski
*Attorney, Agent, or Firm*—Gausewitz, Carr & Rothenberg

[57] ABSTRACT

A movable working head carries a pair of drive rollers, an insertion quill, and a routing nozzle that are manipulated so that a first terminal on one end of a wire is grasped between the rollers and inserted into the quill which is then inserted partly into a connector aperture. The rollers are rotated to drive the wire and terminal through the quill into an engaged position within the connector, terminal insertion is tested, and the insertion quill is replaced with the routing nozzle so that the working head can traverse a harness routing path with the rollers and nozzle sliding freely along the length of the wire towards its other end. Near the second end of the wire, the rollers grasp the second terminal pin, rotate with the pin 180° about an axis parallel to the roller axes and are moved to insert this terminal pin into the insertion quill so that the working head may move the quill and rollers to a second connector.

22 Claims, 24 Drawing Figures

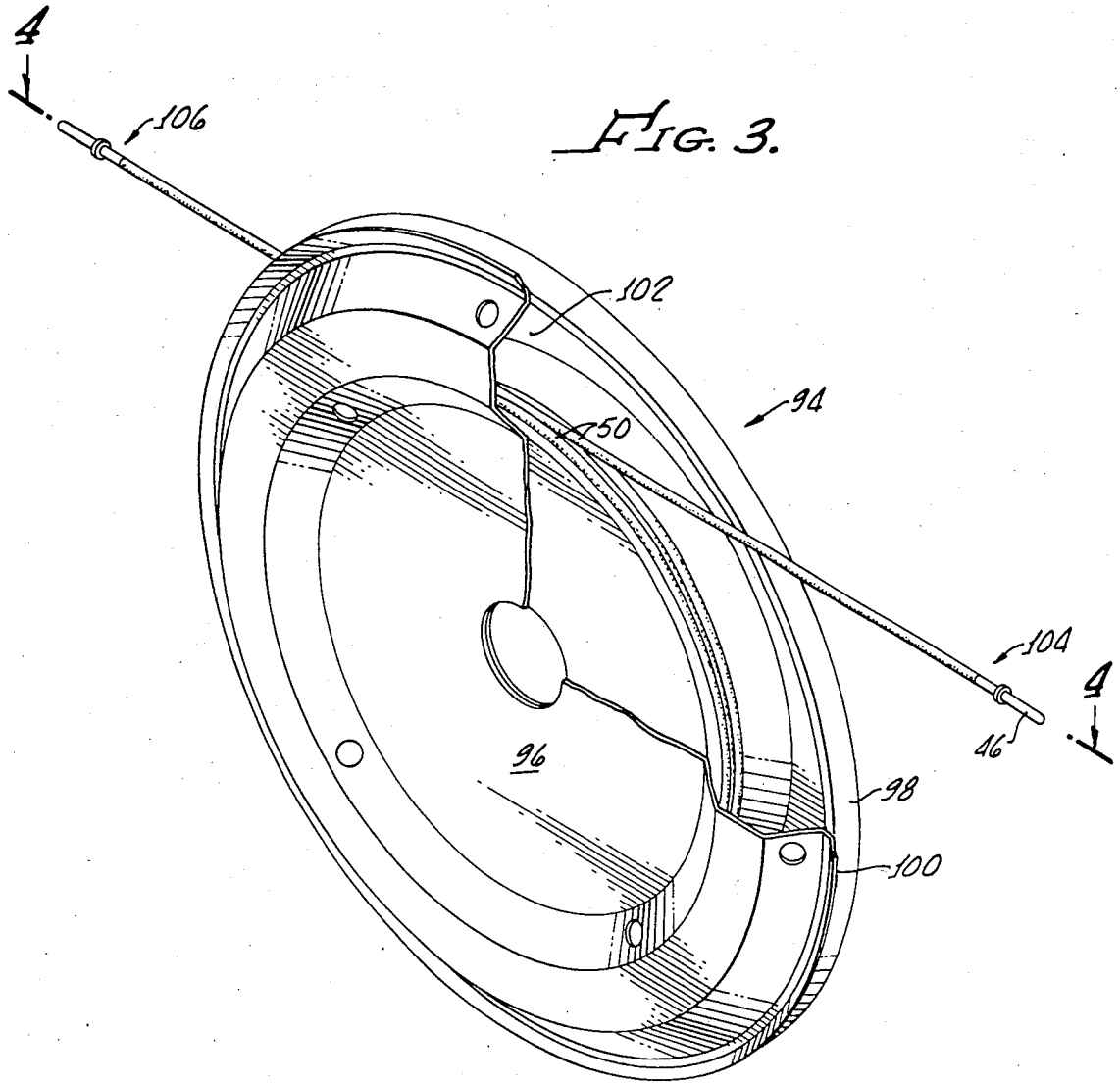
FIG. 3.
FIG. 4.
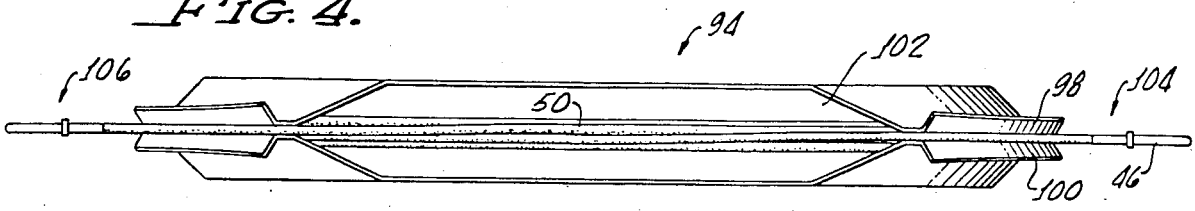

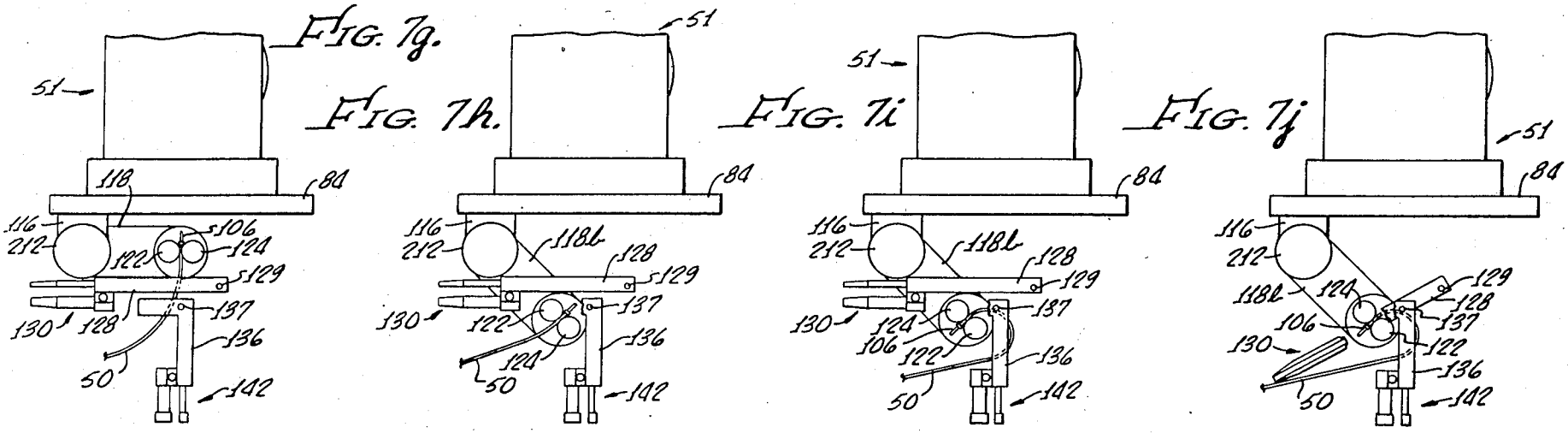
FIG. 7g.
FIG. 7h.
FIG. 7i
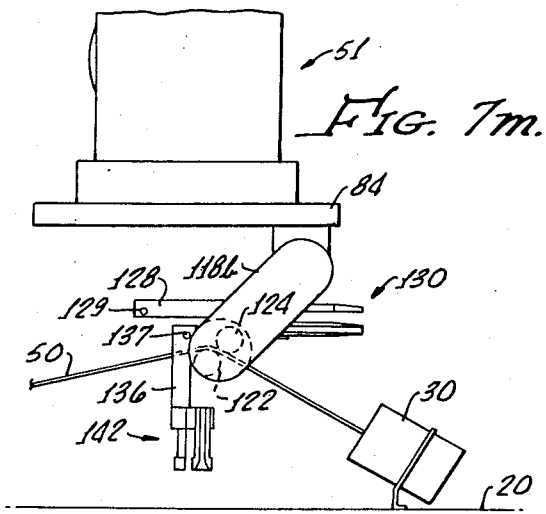
FIG. 7m.
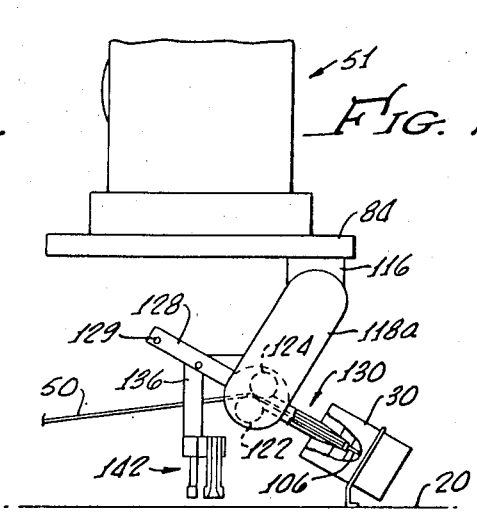
FIG. 7l.
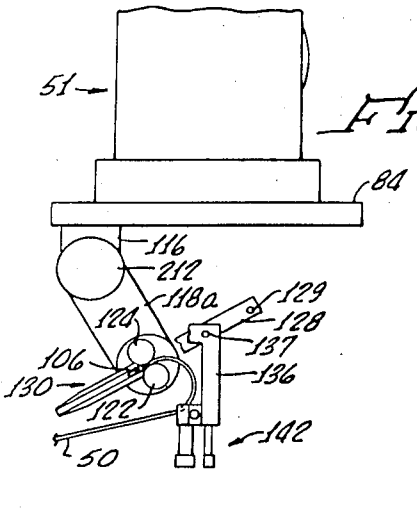
FIG. 7k.

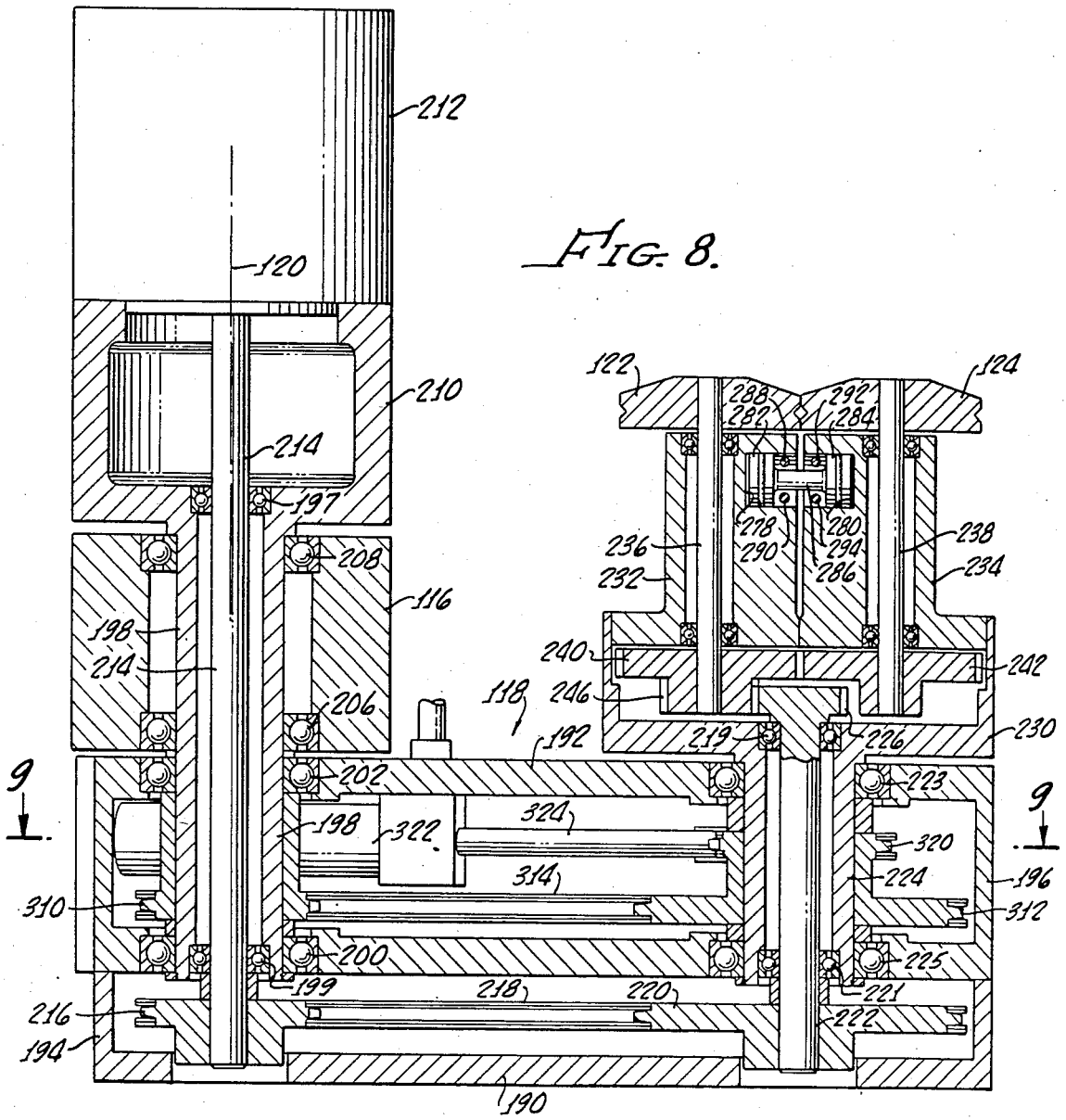
FIG. 8.
FIG. 9.
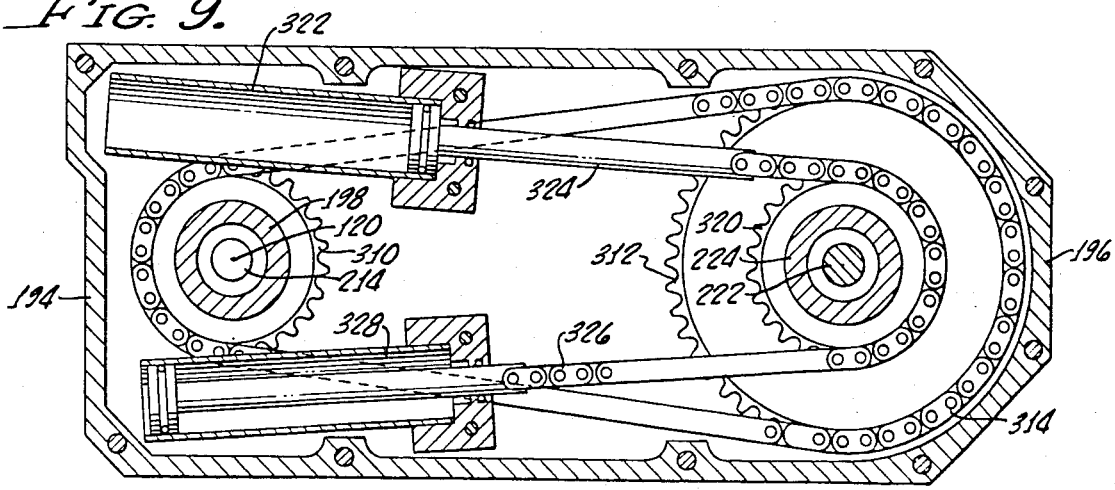

METHOD AND APPARATUS FOR TERMINAL INSERTION

BACKGROUND OF THE INVENTION

The present invention relates to methods and apparatus for assembly of a harness of wires and connectors, and more particularly concerns machine insertion of terminal pins on one or both ends of a wire into one or more multiple pin connectors and routing the wire between the connectors in a desired path.

Electrical wire harnesses embody a number of wires, each having a terminal pin affixed to one or both of its ends. The wires are connected to and between different pairs of multiple pin connectors. Optical fibers, carrying optical signals, and having much greater information carrying capacity, are replacing electrical conductors. Such optical conductors are assembled and connected in arrangements similar to those employed for electrical conductors. Accordingly, the term "wire", as used throughout the description and claims, shall denote either electrical or optical energy conductors.

Many machines devised for automatic assembly of wire harnesses use devices for gripping a wire terminal pin, in a manner similar to manual pin insertion methods, and for moving the pin into the connector while it is so held. Such devices fail to protect the terminal pin during handling, are capable of handling only one end of the wire at a time and must be released from and caused to regrasp the other end of the wire for completion of connection of a single wire that has a pin at both ends.

Many multiple pin conectors have an exceedingly high density of connector apertures, each of which receives a thin delicate terminal pin. A single connector may have as many as 100 or more wires connected to it. After many of the wires have been connected to the connector, the next terminal pin to be inserted must be forced between closely packed wires that have been previously connected. Further, the pin is easily damaged if not precisely registered with the connector aperture. Thus, some means to protect the long slender pin during the insertion process is required.

The Brandewie et al patent, U.S. Pat. No. 4,308,659, describes an attempt to handle assembly of wires with multiple pin connectors by employing a wire guide tunnel positioned at the connector. A wire is laterally delivered to the tunnel, and both the wire and terminal pin are driven through the tunnel into the connector. The patent to Brandewie et al, with its guide tunnel fixedly positioned relative to the connector, requires ejector arms to displace previously connected wires. This apparatus is capable of handling only one end of a wire at one time. It grasps the wire, but not the pin, and thus cannot maneuver the pin conveniently and accurately. An entirely new machine set up must be accomplished for connection of the second ends of the terminal fitted wires. Moreover, the connector in the system of this patented device is moved to be positioned with respect to a fixed wire and terminal feed path. This movement of the connector requires movement of the entire bundle of previously connected wires.

No provision is made in prior art for possible misalignment of the connector aperture with the wire feed path, nor for possible misalignment of apertures of the resilient connector grommet with the connector apertures or with the wire feed path. A multiple pin connector frequently has a resilient wire receiving grommet having a number of apertures, each of which is nominally aligned with an individual one of the terminal receiving apertures of the connector. In the course of insertion of many wires through the grommet into the connector apertures, the grommet may become displaced or distorted so that its remaining apertures are no longer in registry with the connector apertures. The long, slender and delicate terminal pin cannot correct such misalignment during insertion and is likely to be bent upon attempted insertion through a misaligned grommet aperture.

Despite the fact that many harnesses have connectors attached to both ends of the wires, systems for accomplishing machine controlled routing of a wire and protected insertion of both wire ends in connectors are not known in the prior art.

Accordingly, it is an object of the present invention to provide a terminal insertion system that avoids or minimizes above-mentioned limitations.

SUMMARY OF THE INVENTION

In carrying out principles of the present invention, in accordance with a preferred embodiment thereof, a terminal pin of a wire is grasped between a pair of drive rollers and moved to insert the pin into the bore of a protective quill. The rollers and quill are moved together to insert the quill partly into a connector, thereby to correct any possible misalignment of a grommet aperture, and the rollers are rotated to drive the wire and the pin through the quill into the connector. The combination of rollers and quill is retracted from the connector, the quill is replaced with a routing nozzle, and the rollers and nozzle are traversed along a desired wire harness route, with the wire being guided by the nozzle and sliding between but still retained by the rollers, to enable the rollers to reach the other end of the wire and grasp the second terminal pin on the second wire end. The rollers and second terminal pin are rotated about an axis parallel to the roller axes and the second pin is inserted into the insertion quill, whereby the second terminal pin, rollers and insertion quill, may be moved as a unit and the rollers driven to insert the second pin into a second connector.

BRIEF DESCRIPTION OF THE DRAWINGS

FIG. 3 is a perspective view, with parts broken away, of an exemplary reel for holding wire to be assembled in a wire harness;

FIG. 4 is a sectional view taken on lines 4—4 of the reel of FIG. 3;

FIG. 6*b* is a plan view of the bottom of the working head;

FIGS. 7*a* through 7*m* are schematic illustrations of a sequence of operations carried out by the head of FIGS. 5, and 6 during harness assembly;

FIGS. 7*n* and 7*o* illustrate a wedge for removal of the wire from the rollers after insertion of the second terminal pin;

FIG. 8 is a sectional view of the swing arm and pinch rollers of the working head;

FIG. 9 is a section taken on lines 9—9 of FIG. 8;

FIG. 12 is an exploded perspective view of the swing arm and pinch rollers of FIGS. 9–11.

DETAILED DESCRIPTION OF THE INVENTION

Figure 1:
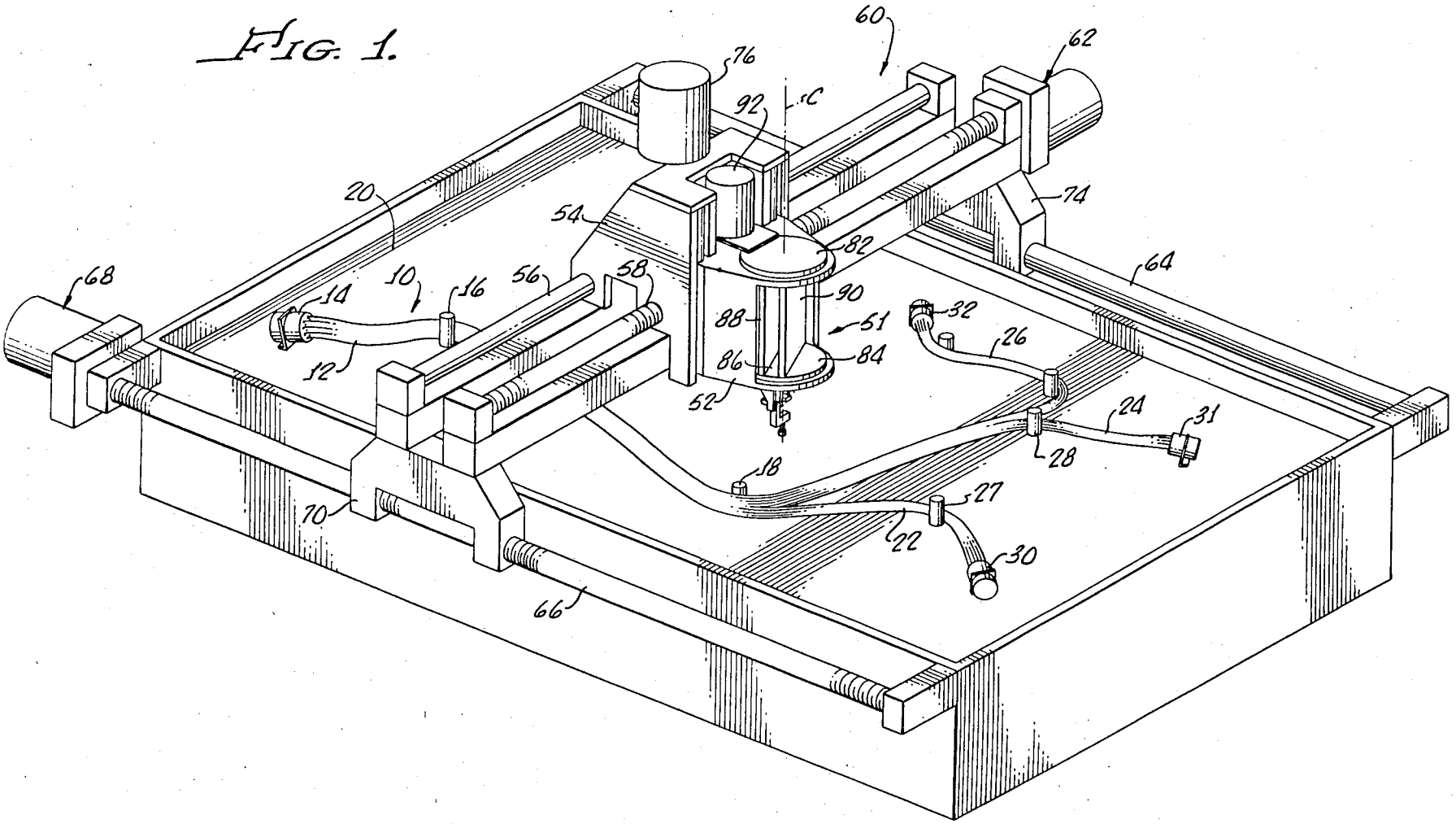
FIG. 1 is a perspective illustration of a harness assembly table and gantry system embodying principles of the present invention.

The function of the method and apparatus described herein is to assemble a harness of electrical wires of the type generally indicated by the exemplary configuration of harness 10 shown in FIG. 1. The harness, as shown solely for purposes of exposition, includes a harness trunk or main branch 12 comprised of a number of individual wires each of which has a terminal pin secured to each end. Each pin on one end of the wires is inserted into an individual one of a plurality of apertures in a high density, multi-pin connector 14. The trunk 12 of the illustrated harness is routed around a pluraity of upstanding guide pins 16, 18, projecting upwardly from the surface of a table 20 upon which the harness is to be assembled. The harness trunk may divide into a number of secondary branches, such as those indicated at 22, 24, 26, which are routed around additional guide posts, such as those indicated at 27, 28 and 29, to additional connectors, such as connectors 30, 31 and 32, all mounted on the assembly table 20.

Figure 2:
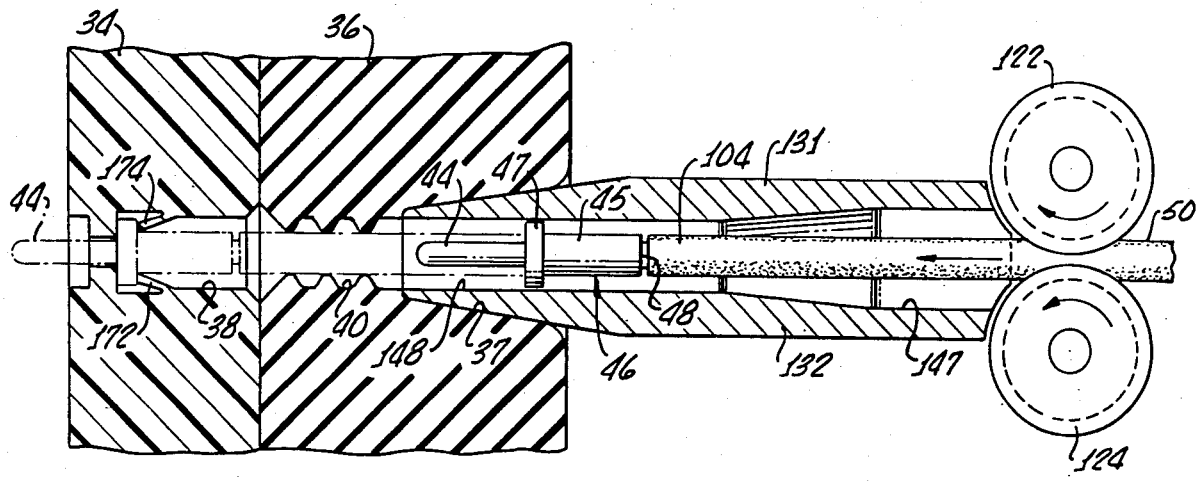
FIG. 2 is a fragmentary sectional view showing, on an enlarged scale, the insertion of a terminal pin and protective quill into a connector.

Illustrated in FIG. 2 is a portion of a typical connector, such as connector 14, having a retainer plate 34 and a resilient grommet 36 each having apertures 38, 40, respectively, that are nominally in mutual alignment so as to receive the long, slender, thin and delicate shaft 44 of a terminal pin generally indicated at 46. The rear section 45 of the terminal pin is separated from shaft 44 by an enlarged shoulder 47 and is crimped or otherwise conveniently secured to the stripped end 48 of an insulated wire 50 of which a large number collectively form the harness 10. The other end of wire 50 is also stripped and connected to an identical terminal pin (not shown in FIG. 2). It will be understood, of course, that such a connector and grommet have many pin receiving apertures, all identical to apertures 38, 40, which are closely spaced so that as many as one hundred or more wires protruding from the face of the connector and from the grommet will be very closely packed one against the other, providing an exceedingly dense and tight bundle of wires.

In assembly of the harness, according to principles of the present invention, a single wire has its first end terminal pin inserted into one connector, such as connector 14, for example, and, after positioning the wire along the desired harness path, has its second end terminal pin inserted into a second connector, such as one of the connectors 30, 31, and 32, for example. Thereafter, a second wire has its ends inserted into its appropriate connectors, to be followed by connection and routing of the third, fourth and subsequent wires. Thus, instead of connecting a first end of each of a large group of wires to a single connector as a first step and thereafter attempting to sort, separate and locate the second ends of individual ones of previously connected wires for connection into the other connectors, each wire, according to one aspect of the present invention, has both of its ends inserted before assembly of a second wire into the harness is begun. The machine that connects and routes also carries the wire to which terminals have been connected at both ends.

The wire is carried and stored on a machine working head 51 carried on a carriage block 52 (FIG. 1). Carriage block 52 is mounted for vertical sliding motion on a carriage 54, which, in turn, is mounted for motion transversely of table 20 on a gantry 60, including a pair of tranverse guides 56, 58, along which it is driven by a motor and gear box 62. Various mechanisms are known for driving such a carriage, such as a screw thread formed on guide 58 engaged with a nut (not shown) carried by the carriage 54. Gantry 60 is itself mounted for motion along the length of the table 20 on longitudinally extending lateral guides 64, 66 of which guide 66 is a screw driven by a motor and gear box 68 and cooperating with a nut (not shown) carried in a gantry leg 70. If deemed necessary or desirable, a similar drive, including a nut in leg 74, on the other side of the gantry, may be provided.

Carriage block 52 is mounted to carriage 54 for vertical motion (assuming for purposes of exposition that table 20 and the various gantry and carriage guides are horizontal) under control of a Z axis motor 76, whereby the carriage block can be positioned at any point in an X, Y, Z Cartesian coordinate system defined by the directions of the three linear motions of the carriage block. Mounted on the vertically slidable carriage block 52, for rotation about a vertical axis C that is parallel to the Z axis of the system, is the working or insertion and routing head 51 which is formed of upper and lower circular rotary plates 82, 84. A wire reel receiving magazine 86 is defined between fixed, mutually spaced upstanding sidewalls 88, 90 which fixedly interconnect plates 82, 84. The working head is rotated about the C axis by a motor 92 carried by the carriage block.

Although the carriage and working head may carry a length of wire in many different configurations, it is found most convenient and most efficient, for all but very short lengths of wire, to mount the wire (having each end stripped and connected to a terminal pin) on a reel 94, such as shown in FIGS. 3 and 4. The reel includes a central hub 96 and outwardly flaring resilient lips 98 and 100 defining between the lips and the hub a wire receiving cavity 102 upon which is wound a wire, which may be up to a hundred feet or more in length. The wire shown is wound upon reel 94 with both its leading end 104 and its trailing end 106 projecting from the reel between and retained by the resilient reel lips 98, 100. For purposes of the present invention, only one wire end need project from the reel. Projection of both ends facilitates prior processing of the wire after it has been wound on the reel including stripping of wire ends and attachment of both terminal pins. The reel is loaded into the magazine or reel chamber defined by walls 88, 90 with its leading end 104 (FIG. 5) projecting downwardly into a guide chute having sides 105, 107 formed by curved bottom portions of the chamber. The reel rests and rotates on the chamber bottom portions 108 as wire is withdrawn from the reel.

In the bottom portion of the reel chamber is a pair of juxtaposed friction rollers, such as roller brushes 110, 112, mounted for oppositely directed rotation about parallel axes. The roller brushes grasp the leading terminal pin 46 and wire end 104 and drive it downwardly through an aperture 114 in the working head bottom plate 84 and through a guide 114*a* fixed to and depending from the bottom plate. The wire withdrawal brushes 110, 112 are driven by a belt 109 and a motor 111 carried on the working head. The reel is manually loaded into the working head chamber and positioned so that the protruding leading end 104 of the wire is grasped by the rotating withdrawal rollers 110, 112. Alternatively, if deemed necessary or desirable, a number of wire bearing reels such as reel 94 may be loaded in a reel storage device (not shown) and removed therefrom one at a time by automatic means for automatic insertion into the reel receiving chamber of the working head 51.

Figure 10:
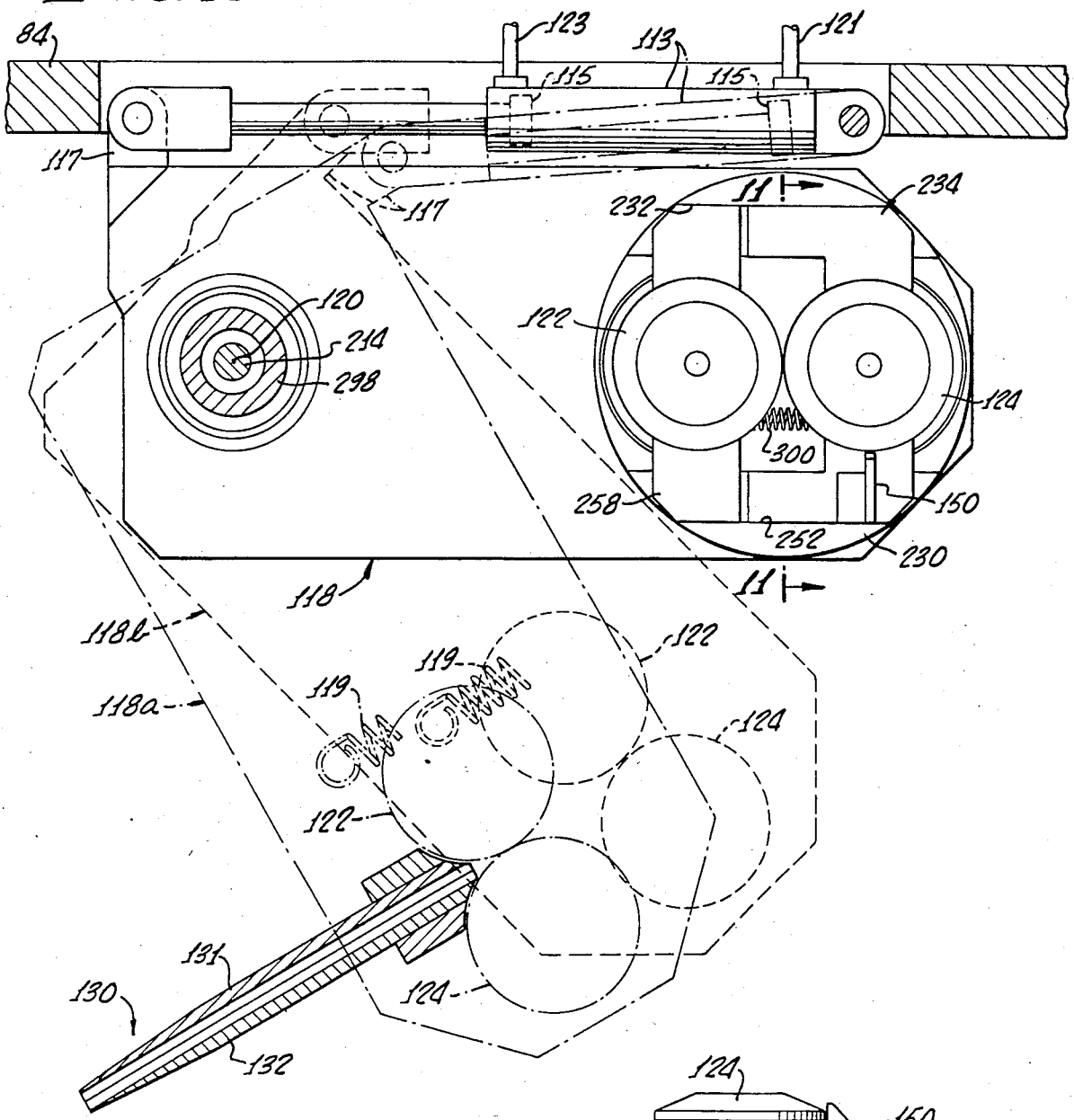
FIG. 10 is a side view of the swing arm and pinch rollers.
Figure 11:
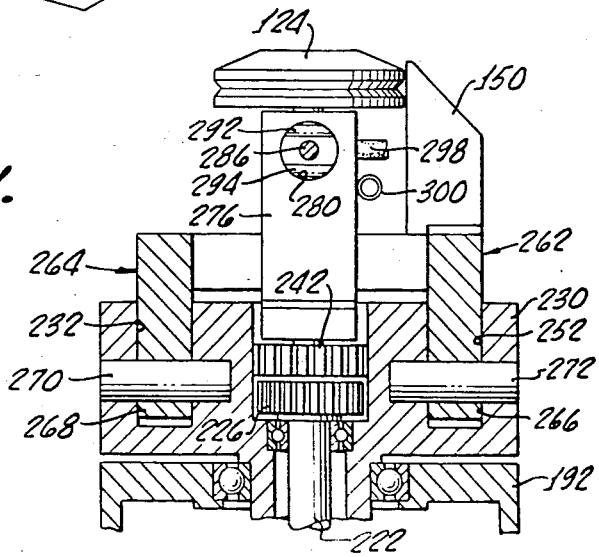
FIG. 11 is a section taken on lines 11—11 of FIG. 10.

A fixed bracket 116 is suspended from the bottom of lower working head plate 84 and mounts a wire drive or swing arm 118 for pivotal motion about a substantially horizontal axis 120. As best seen in FIG. 10, the swing arm is driven by a double acting air motor 113 pivoted at one end to lower working head plate 84 and having a piston 115 pivotally connected to a drive extension 117 on the swing arm. A tension spring 119 is connected between an intermediate portion of the swing arm and plate 84. Air pressure applied solely to one side of the piston via an air hose 121 swings the arm 118 counterclockwise (as viewed in FIG. 10) to its solid line position. Air pressure applied solely to the other side of the piston via an air hose 123 swings the arm clockwise to the phantom line (extreme clockwise) position 118*a* shown in FIG. 10. Absence of applied pressure to both sides of the piston allows the spring 119 to hold the swing arm in an intermediate position 118*b* illustrated in dotted lines. The free end of swing arm 118 carries a pair of juxtaposed pinch rollers 122, 124 that can be driven about mutually parallel spaced axes by a mechanism to be described below. The rollers may be separated from one another by a first relatively small amount that allows the rollers to slide freely along but still retain a grasp of a wire interposed therebetween, and by a second larger amount that allows a terminal pin and its enlarged shoulder to be inserted along the length of the pin between the rollers. The rollers are spring urged toward one another to firmly grasp and pinch either the rear section of a terminal pin or a wire interposed between the two.

Figure 5:
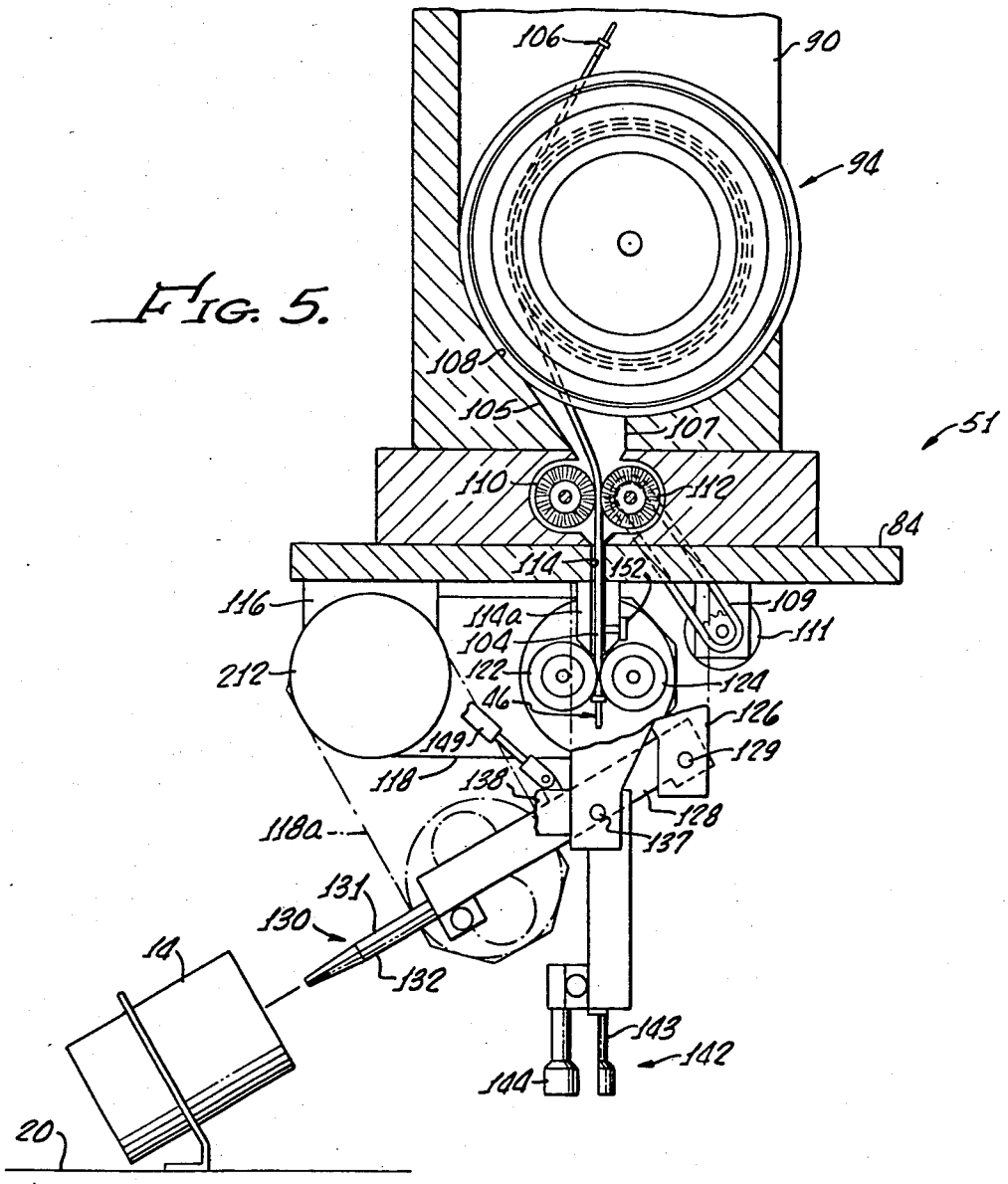
FIG. 5 is a sectional view of a working head of an apparatus embodying the principles of the present invention.

The swing arm pivot and pinch rollers are positioned so that when the swing arm 118 is in its uppermost position, as illustrated in solid lines in FIG. 5, a wire end 104 that is driven downwardly from the reel chamber 86 through aperture 114 and guide 114*a* will follow a path substantially along the common tangent of the rollers so that the leading end terminal pin 46 on the wire end will be received by and between the pinch rollers 122, 124.

Figure 6:
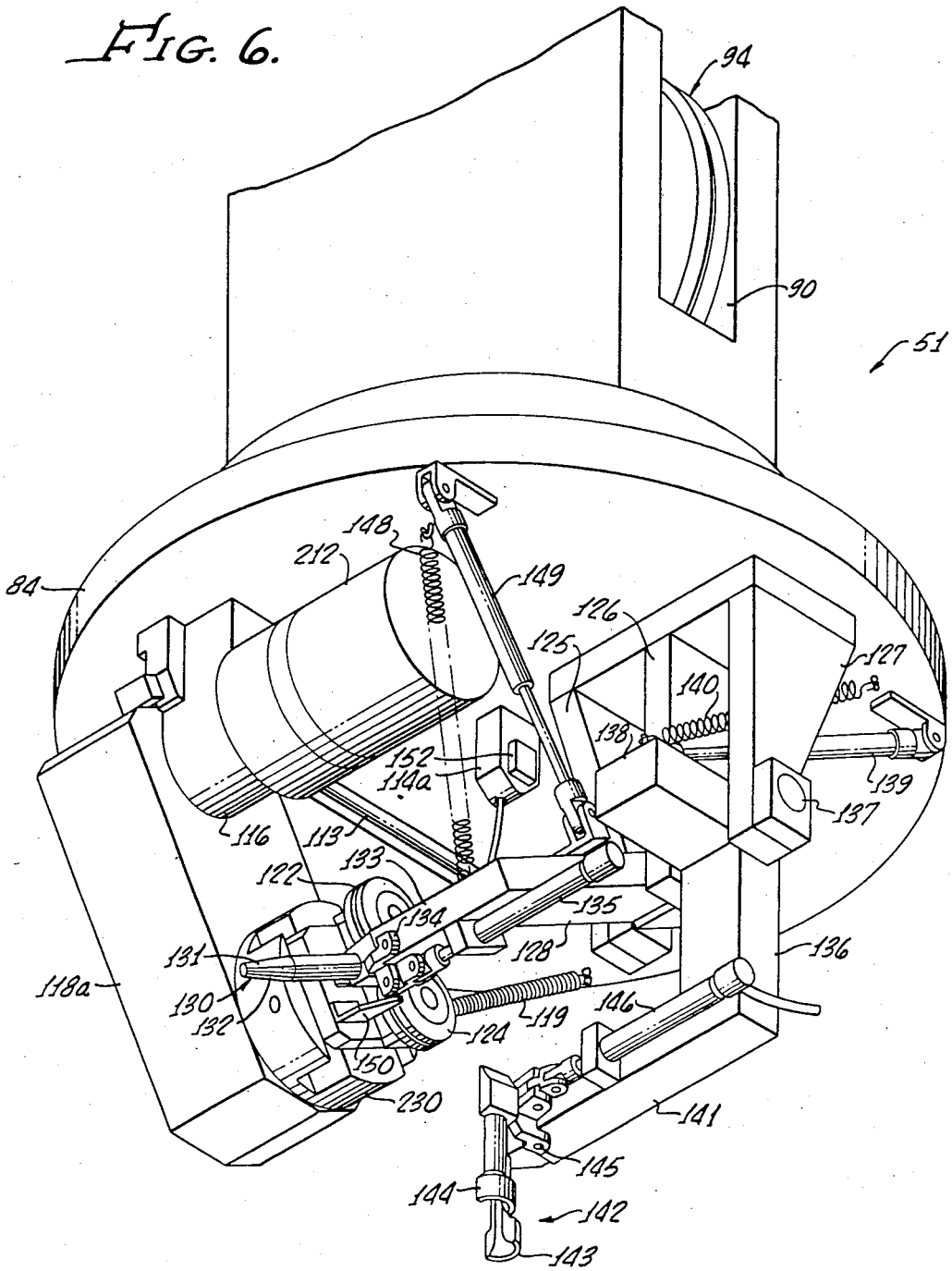
FIG. 6 is a perspective view of the head of FIG. 5.
Figure 6A:
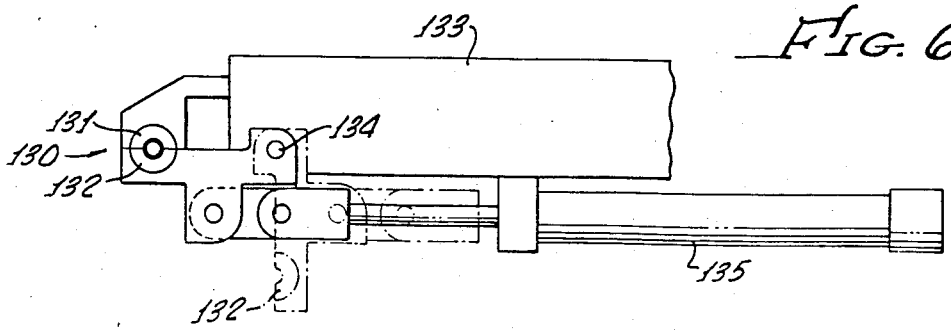
FIG. 6*a* shows details of the quill opening and closing arrangement.

Fixed to and depending from the lower plate 84 is a bracket having mutually spaced parallel depending arms 125, 126, 127 (FIGS. 6, 6*b*). An L-shaped quill insertion arm 128 is mounted between arms 125, 126 for pivotal motion about a first horizontal axis 129. Arm 128 carries a split insertion quill 130 having a relatively fixed upper section 131 and a lower section 132 that is pivoted to a transverse leg 133 about an axis 134 parallel to the longitudinal extent of the arm and driven by an air motor 135 to and from a closed position (FIGS. 2 and 6) wherein the two quill halves are adjoining to form a protective sheath that fully encloses a terminal pin. Upon retraction of the piston rod of air motor 135, the lower quill section 132 swings downwardly to an open position (FIGS. 6*a*, 6*b*) sufficiently displaced to clear a pin or wire grasped between rollers 122 and 124 when the open quill and its support arm 128 are pivoted about axis 129 in a counterclockwise direction from an upper position (shown in FIG. 7*a*). Support arm 128 is held in its upper position by a tension spring 128 connected between plate 84 and an intermediate portion of the arm. An air motor 149, pivotally connected between plate 84 and an intermediate portion of support arm 128, is extended to pivot the arm downwardly to operative position. As can be seen in FIG. 2, the quill parts, when in closed position, provide a pin and wire end receiving bore that has a tapered rear portion 147 and a cylindrical forward portion 148 that closely slidably receives the pin shoulder 47. The enlarged and slightly tapered rear portion 147 of the quill bore facilitates insertion of the pin into this end of the closed quill.

A nozzle support arm in the form of a bell crank 136 is mounted between bracket arms 126, 127 for pivotal motion about a substantially horizontal axis 137 that is displaced from the quill arm axis 129 (FIG. 5). Extending from one side of pivot 137, the bell crank carries a drive leg 138 to which is pivoted the piston rod of an air motor 139 that is pivoted at its other end to the plate 84. A nozzle support arm tension spring 140 is connected between drive leg 138 and plate 84 to swing the free end of the arm upwardly for grasping a wire as will be described below. Extension of the air motor piston rod drives the bell crank in a counterclockwise direction (as viewed in FIG. 5). Mounted to a transverse leg 141 fixed to the end of arm 136 is a routing nozzle 142 having a fixed lower half 143 and a movable upper half 144 pivoted to transverse leg 141 about an axis 145 substantially parallel to the longitudinal extent of the arm. The split nozzle parts may be closed to provide a routing guide bore of relatively large diameter through which a wire may freely travel as the nozzle is moved along the length of the wire. Movable nozzle half 144 can be pivoted relative to the fixed half 143 so as to clear a wire grasped between the pinch rollers 122, 124 as the nozzle and its support arm 136 are swung about pivot 137 in a clockwise direction to the position shown in FIG. 7*e*. Movable nozzle half 144 is actuated by an air motor 146 carried by transverse leg 141 and having a piston rod pivoted to the movable nozzle half.

METHOD OF INSERTION AND ROUTING

FIGS. 7*a* through 7*m* are diagrammatic illustrations of successive steps in one method of terminal insertion and routing that can be carried out with the described apparatus. A reel having a routing wire with terminal pins on both ends is loaded into the insertion head chamber, as previously described, so that the leading end of the wire is driven by the withdrawal rollers 110, 112 to and between the partially opened and rotating pinch rollers 122, 124. In partially open position, the entire terminal pin, including shoulder 47, can pass longitudinally between the rotating rollers. During this initial portion of the operation, the swing arm 118 is in its uppermost or wire loading position, being horizontally directed as shown in FIGS. 5 and 10 (solid lines) and in FIG. 7*a*. Both the nozzle 136 and insertion quill 130 are initially swung to the positions shown in FIG. 7*a* in solid lines. An optical sensor 152 on the swing arm 118 transmits light and receives an enhanced reflection from the terminal pin to detect approach of the pin to the rollers. The brush motor drive is then slowed and the pin passes between and slightly beyond the rollers, where the forward wire motion is stopped. The partially open rollers are now stopped and closed on the wire, driven in a forward direction to be certain that the terminal pin has passed, and then driven in reverse to pull the pin back toward the rollers which have electrically conductive surfaces connected in a signaling circuit. Thus, a signal is provided when the rear of the terminal pin is pulled to and between the rollers. The roller drive is stopped, and roller rotational positon, as indicated by a roller rotation position encoder (not shown), is noted or "zeroed". Alternatively, roller rotational position is determined and stored as the number of drive pulses that are fed to the step motor 212 that drives the rollers (as described below). With the rollers closed to firmly grasp the rear section of the pin (as shown in FIGS. 5 and *7a*), the carriage and the insertion head are traversed in X, Y and Z directions until the working head is close to but spaced from the connector into which the first terminal at the first end of the wire is to be inserted.

The connector axis, which is parallel to the several mutually parallel axes of the many pin receiving apertures in the connector, extends at an upward angle to the horizontal surface of the table. If the connector axis is horizontal, there may be interference with motion of the head for insertion of a terminal because the motion, in such case, must be parallel to and close to the table surface where interferring devices such as other wires of the cable harness, guide posts, and other connectors may be present. If the connector axis, on the other hand, is at 90° to the horizontal, a terminal pin may be inserted straight downwardly without interference with the harness or guide pins, but, in such a case, the entire bundle of harness wires, which lies in a substantially horizontal plane, will bend 90° relative to the connector face. Such a bend is difficult because of the stiffness of a large, closely packed, high density bundle of wires and, moreover, will result in a significant change in length of wire between connectors. Accordingly, an intermediate angle is preferred in order to minimize interference with head motion and also to minimize the angle of bend required of the wires at the connector face. As presently preferred, all connectors are fixedly positioned so that the connector axis extends at approximately 30° to the plane of the table (FIGS. *7b–7f*), although any angle may be employed. However, if any connector is mounted above the table, its axis may be horizontal because the problem of interference with devices at or near the table surface is minimized or eliminated.

As described above, the rollers are closed to firmly and rigidly grasp the rear portion of the pin, with the forward portion of the pin projecting tangentially from between the rollers. Air motor 149 is actuated and quill arm 128 is swung downwardly, in a counterclockwise direction, from the solid line to the dotted line position of FIG. *7a* until the insertion quill axis is positioned along a line parallel to the connector axis 15 which makes a 30° angle with respect to the horizontal. The quill halves 131 and 132 are closed by extension of air motor 135, and double acting air motor 113 is actuated via air hose 123. This retracts the motor piston, and the swing arm 118 is pivoted downwardly about its pivot axis 120 to a second or quill load position (FIG. *7b* and position 118*a* of FIG. 10) wherein the common tangent to the two rollers is aligned with the axis of the insertion quill. The angle between the axis of the swing arm and the plane of the bottom of insertive head plate 84 in this position is denoted by $\alpha_1$. As the swing arm pivots to this position, the forward projecting portion of the pin 46 is inserted into the rear portion of the closed quill. The rear end of the quill has its curved surfaces positioned substantially against and in mating relation with the two closed pinch rollers 122, 124 (as best seen in FIG. 2).

Now the entire head is moved in X, Y and Z coordinates and rotated about the C axis so as to move the quill and roller combination as a unit. During this motion, the first terminal pin is rigidly held between the rollers and protected by the enclosing quill halves. The head moves downwardly along the connector axis 15, to the position shown in FIG. *7c*, until the forward end of the insertion quill enters the appropriate grommet aperture so that the forward end of the quill is at or substantially at the bottom of the tapered camming entrance portion 37 (see FIG. 2) of the grommet aperture. With the connector fixed in position, and the position of its several apertures known, the line of motion of the insertion head, carrying the quill and roller assembly, is directed to align the pin with the aperture 38 (FIG. 2) of the connector retainer plate. If the aperture 40 of the grommet has been displaced or distorted in some manner so that it is no longer aligned with its associated retainer plate aperture, the motion of the insertion quill forward end, as it approaches the entrance portion 37 of the grommet aperture, causes the forward end of the quill to engage the sides of the grommet entrance aperture. This cams the grommet so that the grommet aperture 40 is forced into alignment with the quill and thus is moved to alignment with the retainer plate aperture 38.

When the insertion quill has entered the grommet aperture, (e.g., partially entered the connector) and is in the position of FIG. *7c*, motion of the entire head for quill insertion is terminated and the pinch rollers 122, 124 are driven in mutually opposite directions by roller drive step motor 212 (FIG. 5) so that the pin is driven from the rollers and further into the insertion quill (FIG. 2). Distance traveled by the pin from the rollers is measured as by monitoring pinch roller rotation, for example. The spring urged rollers grip the wire 50 adjacent the rear end of the pin and continue to frictionally drive the wire, thereby further driving both wire and terminal through the insertion quill. The pinch roller drive is continued for a predetermined distance which is sufficient to move the terminal pin from the pinch rollers to the dotted line position illustrated in FIG. 2, in which position the terminal pin has been properly inserted into the connector and locked in place in the connector by resilient connector fingers 172, 174 as is well known in the art.

With the terminal pin inserted, attainment of the proper position of the terminal pin within the connector can be readily tested by any one of several arrangements. For example, the rollers may be driven in reverse with a relatively low torque applied (a torque of about seven pounds) since a proper connection of the terminal will resist a pull of more than ten pounds. If the pin is withdrawn under a torque of seven pounds or less, it is known that the connection is not adequate and the pin will have to be reinserted. If the test is provided by reversing direction of the rollers, the tension thus applied to the now connected wire and terminal pin will produce a strain on the swing arm 118, which may be measured by a strain gauge. As an alternative method of testing, the swing arm 118 may be powered in a counterclockwise direction from the position of FIG. 7*c* with a predetermined test torque that applies to the pin a withdrawal pull of seven pounds.

Figures 7A, 7B, 7C, 7D, 7E, 7F:
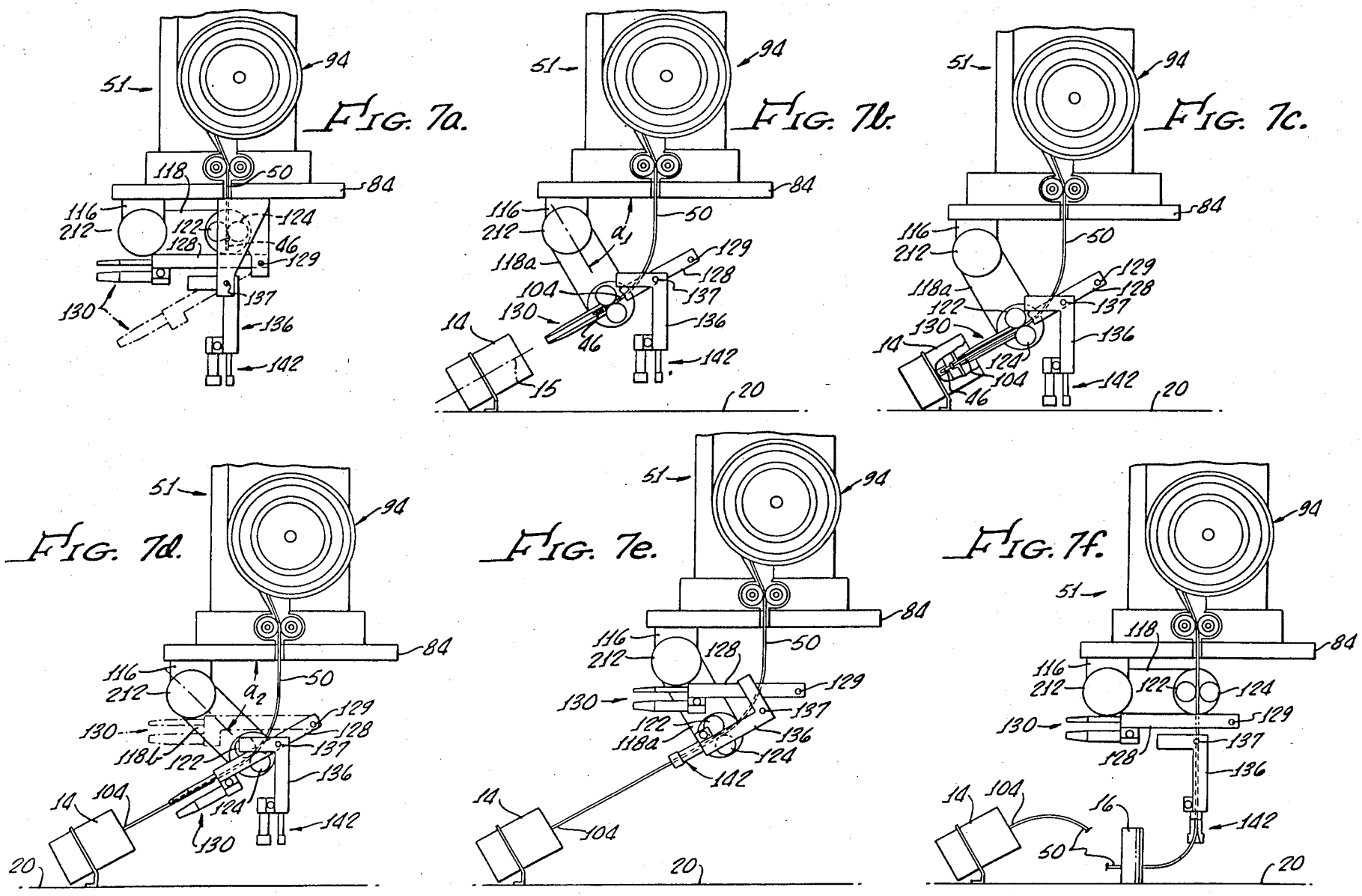

After the pull test has been satisfactorily completed, the rollers are spread apart to a first or partially open position, in which the wire is free to slide between the rollers, but in which the space between the rollers is too small to allow the pin and its shoulder to slide between the rollers. The wire remains loosely captured between the rollers. The entire head is then retracted to a position spaced several inches from the connector, allowing the now connected wire, of which the one end remains secured to the fixedly positioned connector 14, to slide through the insertion quill and between the rollers. Swing arm 118, which had been positioned at the angle $\alpha_1$ in the operations described in connection with FIGS. 7*b* and 7*c*, is now retracted from the quill load or second position to an intermediate or third position (FIG. 7*d*) in which the axis of the swing arm 118 makes an angle $\alpha_2$ with the plate 82, where $\alpha_2$ is smaller than $\alpha_1$. This third position, illustrated in dotted lines as 118*b* in FIG. 10, is achieved under control of spring 119, with both sides of the double-acting air motor 113 depressurized. This displaces the rollers from the rearward end of the quill so that the two halves of the insertion quill may be swung open by retraction of the piston rod of air motor 135. Pressure is then applied to air motor 113 via hose 121 to pivot the quill arm counterclockwise to the out of the way position illustrated in dotted lines in FIG. 7*f*.

With the insertion quill in out of the way position, and the swing arm in its intermediate position at the angle $\alpha_2$, air motor 139 is depressurized to allow spring 140 to swing nozzle arm 136 in a counterclockwise direction to move nozzle 142 into a position (FIG. 7*e*) aligned with wire 50, which now extends from the rollers to the connector 14. The movable half 144 of the nozzle, which is in open position as it moves into the position of FIG. 7*e*, is pivoted, by extension of air motor 146, to close the two nozzle halves about a portion of the wire extending between the pinch rollers and the connector 14. Now the swing arm 118 is pivoted counterclockwise to its first or out of the way position, as shown in FIG. 7*f*, and air motor 139 is pressurized to swing the nozzle arm 136 counterclockwise to a substantially vertical position (shown in FIG. 7*f*) to provide a nearly vertical path for wire 50 from the reel 94 in the insertion head chamber, between the partly open rollers 122, 124, and thence to and through the routing nozzle 142 to its end connection at terminal 14.

With the parts in the position illustrated in FIG. 7*f*, the entire head is moved as desired in X and Y directions so as to route the wire 50 along a desired horizontal path across harness table 20 and around the various routing pins, such as pin 16 (FIG. 1). The head is moved toward the second connector, to which the second end of the wire 50 is to be attached. During this traversing motion, all movable parts of the head, other than the routing nozzle 142, are in withdrawn position to minimize interference with the traverse. As the head traverses, the motion of the routing nozzle pulls wire (which has one end fixed to connector 14) from the reel 94. The wire is guided through the nozzle and over a rounded edge or roller (not shown) mounted thereon. If deemed necessary or desirable, the nozzle may be castered so as to pivot about a vertical axis and maintain alignment of the axis of any roller or the nozzle across the length of the wire which is being drawn through the nozzle. The wire remains captured between but freely slidable along the partly open rollers 122, 124 during traverse of the head.

As the insertion head nears the end of its traverse and begins to approach the second connector, its motion is slowed, sensor 152 detects approach of the second terminal pin 106 to the partly open rollers 122, 124 and motion of the head is stopped. The rollers are closed and driven forwardly to pull the second pin to the rollers (FIG. 7*g*). When the shoulder of the second pin contacts both rollers, an electrical circuit is completed, as previously described, to provide a signal upon occurrence of which the roller rotation position is again noted or "zeroed" (or count of roller drive pulses to step motor 112 is begun).

Now the swing arm is moved down to its intermediate position ($\alpha_2$ position), as shown in FIG. 7*h*, and the two rollers together are rotated 180° (in a counterclockwise direction as viewed in FIG. 7*h*) about an axis parallel to the roller axes and passing through the point of common tangency of the rollers. Upon completion of this 180° rotation, the parts are in the position illustrated in FIG. 7*i*. Now the routing nozzle halves are separated to allow the wire to be withdrawn from the nozzle upon further motion of the head or swing arm. With the swing arm in its intermediate position, as illustrated in FIG. 7*j*, the quill 130 then (or at some earlier step of the operation, to save time) is swung counterclockwise to its insertion position in which the axis of the quill is at the same angle to the horizontal as the axis of the second connector. Because the swing arm is now in its intermediate position, the rollers 122, 124 are slightly spaced from the rearward end of the quill. Further clockwise motion of the swing arm 118 to the quill load position, illustrated in FIG. 7*k*, inserts the second pin 106, still rigidly grasped between the now tightly closed rollers, partly into the insertion quill. Now the entire insertion head may be moved, as necessary or desirable, to position it close to and ready for insertion of the quill into the second connector, such as connector 30. The entire insertion head may be rotated about the C axis (as required by orientation of the second connector) so that the insertion quill, which is contiguous to the now rotated rollers, has its axis aligned with the axis of the selected aperture of the connector. FIGS. 7*l* and 7*m* show the entire head rotated a full 180° (as an example).

Now steps described above in connection with insertion of the first pin are repeated. The entire insertion head is moved along the axis of the connector aperture to partially insert the quill into the grommet aperture, aligning the grommet aperture with the connector aperture, if necessary, as shown in FIG. 7*l*. With the quill partly inserted into the grommet aperture and the second pin 106 still rigidly grasped between the rollers and enclosed by the insertion quill, the rollers are both driven in a direction opposite to the direction in which they are driven for insertion of the first terminal pin. This drives the second pin from between the rollers and through the insertion quill. The roller drive on the wire continues, as before, until the pin has reached its desired completely inserted position. A pull test is accomplished, as previously described, and, if successful, the entire head is retracted from the second connector, the swing arm is moved back to its intermediate ($\alpha_2$ position), and the insertion quill is opened and moved upwardly to an out of the way position. The rollers are opened to a full open position, and the two rollers are rotated 180° about an axis parallel to the roller axes and passing through their common tangent, being rotated back to their initial position. In the course of the second 180° rotation of the two rollers, the wire is pulled from between the fully opened rollers, and the apparatus is then ready to be positioned for handling of a second wire. If deemed necessary or desirable, a wedge-shaped wire lifter 150 (FIGS. 7*n* and 7*o*) is mounted on the rotatable roller housing to ensure removal of the wire from between the rollers as the rollers are rotated 180° back to their initial position. The now empty reel 94 is removed from the reel receiving chamber, and a second reel, carrying a second wire that has terminals connected to both of its ends, is inserted, as previously described, and the process is repeated for connection of the terminal pins on the ends of the second wire to the desired connectors.

It will be seen that once the first terminal pin is grasped by the pinch rollers, the rollers never leave the wire until insertion of the second terminal pin has been completed. The rollers merely slide along the wire from one end to the other, and the direction of their driving rotation is reversed to drive the second terminal pin.

WIRE AND SWING ARM CONSTRUCTION

As illustrated in FIGS. 8 through 12, swing arm 118 includes an arm housing having spaced side plates 190, 192 interconnected by end plates 194, 196 and journalled on a motor shaft housing 198 by means of bearings 200, 202. Shaft housing 198 is journalled on bracket 116 fixed to and depending from the bottom plate 84 of the insertion head 80 by means of bearings 206, 208. Shaft housing 198 is fixed to a motor housing 210 that mounts a step motor 212 that drives the pinch rollers 122, 124 by means of a motor shaft 214 running through and journalled in shaft housing 198 on bearings 197, 199. Shaft 214 has a drive sprocket 216 fixed to an end thereof. A drive chain 218 is entrained around sprocket 216 and extends to and is entrained around a second sprocket 220 fixed to a roller common drive shaft 222 that extends through and is journalled within a rotatable roller housing section 224 on bearings 219, 221. A sun gear 226 is fixed to the other end of shaft 222.

Roller housing section 224 is journalled in the swing arm structure on bearings 223, 225, and is fixedly connected to a common base section 230 which carries a fixed roller housing section 232 and a pivoted roller housing section 234. Journalled in the housing sections 232 and 234 are roller drive shafts 236 and 238, respectively, carrying, at their inner ends, drive gears 240, 242, respectively, and at their outer ends carrying the rollers 122, 124, respectively. Gear 242 meshes with gear 240 which is fixedly connected with a common drive gear 246 which, in turn, is driven by engagement with sun gear 226.

As best seen in FIG. 12, common base section 230 is formed with a pair of spaced parallel transverse slots 250, 252, which respectively receive spaced legs 254, 256 of a transverse section 258 of the fixed housing section 232. A central upstanding section 260 of fixed housing section 232 is fixed to the section 258 and rotatably mounts roller shaft 236, to which roller 122 is fixed.

Pivoted housing section 234 has a pair of laterally spaced L-shaped legs 262, 264 each having an apertured ear 266, 268, respectively received in slots 252 and 250 of the common base section 230. Pivot pins 270, 272, fixed in the common base section 230, extend through the apertures of the respective ears 268, 266 and pivotally mount the housing section 234 to the common base 230. A central upstanding section 276 is fixed to the legs 262, 264, and journals the shaft 238 that fixedly carries roller 124. Central sections 260 and 276 of the two roller housings are formed with mating bores 278, 280 (see also FIG. 8) that respectively receive pistons 282, 284 that are rigidly interconnected by a common shaft 286. Stop pins 288, 290 in central section 260 and stop pins 292, 294 in central section 276 limit motion of each piston in a direction that tends to move the piston out of its associated bore. Air fittings 296, 298 admit air to the respective bores 278, 280 between the bottom of each bore and the outer face of each piston to thereby tend to drive each piston from its bore. Pressurized air is independently and separately applied to each of the fittings 296, 298 so that air applied to one of the fittings will move its piston relative to the housing section until the piston hits the stop pins, thereby mutually displacing the rollers by pivoting the housing section 276 about pins 270, 272. Air under pressure admitted to the other fitting will similarly drive the second piston, thereby causing a relative displacement of the two rollers that is independent of the first mentioned displacement. Accordingly, if air is applied to one of the fittings, the rollers will be displaced by a first amount according to the travel available to one of the pistons. If air is admitted to both of the fittings, the rollers will be displaced by a second larger amount according to travel allowed to both of the pistons together. A tension spring 300 interconnects the two central sections 260 and 276 and urges the rollers firmly against one another so as to cause the rollers to grasp the pin or wire interposed therebetween in the absence of air admitted to either of the fittings 296, 298. Accordingly, the rollers may be mutually displaced by a first distance to allow the rollers to freely slide along a wire by admitting air to one of the fittings, and may be displaced by a greater distance to allow the larger terminal pin shoulder to pass between the rollers by admitting air to both of the fittings at the same time.

Shaft housing 198 has a second sprocket 310 affixed thereto and roller housing 224 has a sprocket 312 fixed thereto, the two sprockets being interconnected by a second chain 314 entrained over the sprockets.

Rotatable roller housing section 224 has a third fixed sprocket 320 affixed thereto and an air motor 322 (FIGS. 9, 12) fixed in the swing arm, has a piston driven shaft 324 of which an end is connected to a belt 326 entrained over sprocket 320 and having its opposite end connected to an air motor 328 also fixedly mounted within the swing arm 118. The air motors 322, 328 are actuated alternatively to rotate both rollers in unison, about the axis of shaft 222, relative to the swing arm.

Actuation of step motor 212 causes opposite direction rotation of both of the pinch rollers 122, 124 to thereby drive a pin or wire interposed between and grasped by the rollers, as previously described. Actuation of air motor 322 (while air motor 328 is not actuated) will retract the piston driven shaft 324 to rotate the sprocket 320. This rotation of sprocket 320 rotates the roller housing section 224, carrying all of the rotor housing with it to effect the previously described rotation of the rollers through 180° about an axis parallel to the roller axes and extending through their point of common tangency. Release of pressure in air motor 322 and actuation of air motor 328 rotates the sprocket and roller housing section 324 in the opposite direction, returning the roller housing sectio through 180° of rotation to the initial position.

It is desirable that longitudinal position of the wire and terminal relative to the rollers be known and controlled at all times. Thus, upon starting insertion of a first terminal, the first terminal pin is positioned precisely at and between the rollers. Knowing the starting position, a predetermined and precisely controlled amount of roller rotation drives the pin a known distance from the rollers and thus enables the pin to be driven from the position of FIG. 2, wherein the insertion quill is partly inserted into the grommet, with the pin still grasped between the rollers, to the fully inserted position wherein the pin has been driven forwardly to the dotted line position of FIG. 2. Thus, the position of the pins on each end of the wire is known and controlled by applying a selected number of stepping drive pulses to the roller driving stepping motor 212 (or by a suitable encoder that tracks roller rotation). However, as the swing arm 118 is pivoted about the axis of shaft 214, sprocket 220 and common roller shaft 222 both rotate about the axis of shaft 214, causing the chain 218 to rotate sprocket 216 and thereby rotate the motor shaft 214. This rotation of motor shaft 214 will cause rotation of the rollers in the absence of any commanded driving by the stepping motor and must be avoided if precision control of wire end position is to be maintained by controlling the number of applied stepping drive pulses. Similarly, as the two rollers and their housing are rotated together 180° by operation of air motors 322 or 328, roller drive gear 246 revolves around sun gear 226, thereby again rotating the rollers. This, too, is a rotation that is not desired if open loop position control of the driven wire is to be maintained by controlling the number of applied pulses.

These undesired rotations are eliminated by the sprockets 310, 312 and chain 314. As the swing arm rotates about the axis of shaft 214, sprocket 312 also rotates about the same axis, thereby rotating sprocket 310 and housing 198. Rotation of housing 198 effects rotation of the housing of motor 212, and thus the undesired rotation of the shaft 214 is compensated by the concomitant rotation of motor housing 212.

Similarly, as the roller housing 224 is rotated about the axis of shaft 222, chain 314 effects rotation of housing 198 and the housing of motor 212, thereby effecting rotation of the motor that compensates for rotation of the rollers caused by revolution of gear 246 about sun gear 226. This compensatory rotation is achieved by the fact that the rotation of the motor housing 210 causes shaft 214 to rotate therewith and thereby effects a rotation of the rollers that compensates for roller rotation caused by the rotation of the roller housing. Sprockets 310, 312, chain 314, and air motors 322, 328 also operate to brake rotation of motor and motor shaft housings 210, 198 when shaft 214 is driven to rotate the rollers about the axes of roller shafts 236, 238.

Principles of the invention may be applied for machine insertion of only one terminal pin, on only one end of a wire, into a connector. A group of wires, each connected at only one end to a common connector may be transported to a harness assembly table where the wires will be routed to have the terminal pins on their free ends inserted into other connectors, manually or as otherwise desired. In such an application, the 180° rotation of the rollers is not needed and the insertion head structure may be simplified by eliminating those parts required for such rotation.

One or more or all of the several motors and actuators may be manually controlled in the described sequences. Preferably, a suitably programmed digital control computer, having feedback inputs from sensors on the apparatus, is employed to drive the motors and actuators at proper times and in proper sequences for carrying out the described operations.

Although the apparatus and method have been described in connection with insertion of terminal pins on both ends of a wire, it will be readily appreciated that principles of the invention are fully applicable for insertion of wires, each of which has a terminal only on one of its ends.

The foregoing detailed description is to be clearly understood as given by way of illustration and example only, the spirit and scope of this invention being limited solely by the appended claims.

I claim:

1. A method of inserting into a connector aperture a wire having a first terminal fixed to a first end of the wire, said method comprising the steps of:

mounting a connector having a connector aperture upon a connector support, grasping said first terminal with a pair of rollers, enclosing the terminal in a protective quill, moving the rollers together with the quill relative to the support and toward the connector aperture, thereby positioning the quill adjacent the connector aperture, and rotating the rollers, thereby driving the terminal from the quill into the connector aperture, whereby the quill is moved toward the connector aperture with the terminal enclosed in and protected by the quill, and the terminal is then driven from the protective quill into the connector aperture.

2. The method of claim 1, wherein the terminal is completely enclosed by the quill, and including the step of partly inserting the quill into the connector aperture while the terminal is completely enclosed by the quill and before the terminal is driven from the quill, thereby ensuring alignment of the quill and aperture.

3. The method of claim 1 wherein said step of enclosing the terminal comprises relatively moving the rollers and the quill toward each other, thereby inserting the terminal into the quill while the terminal is grasped between the rollers.

4. The method of claim 1, including the steps of mounting a second connector on said support, moving the rollers relative to the support toward a second end of the wire and toward said second connector, said wire having a second terminal fixed to said second end, and rotating the rollers in reverse direction, thereby driving said second wire end and second terminal from said rollers toward said second connector.

5. The method of claim 4 wherein said step of moving the rollers toward a second end of the wire includes the steps of moving a portion of the wire relative to the support and toward said second connector, and including slightly displacing said rollers from one another, thereby permitting the wire to slide between the rollers, and further including the step of moving the rollers toward one another when the rollers are adjacent the second end of the wire, thereby grasping the second wire end between the rollers.

6. The method of claim 5, including the step of grasping the second terminal with said rollers, rotating said rollers and second terminal about an axis parallel to the axes of the rollers, and enclosing said second terminal in a protective quill.

7. A method of assembling a wire harness composed of at least a pair of connectors and at least one wire having first and second ends attached to respective ones of the connectors, said method comprising the steps of:

mounting first and second connectors in mutually spaced relation, grasping a wire adjacent its first end between a pair of rollers, rotating the rollers in a forward direction, thereby driving said first end into the first connector, moving the rollers along the wire toward the second end of the wire and toward said second connector, and rotating the rollers in a reverse direction, thereby driving said second end of the wire into the second connector.

8. The method of claim 7 wherein said step of moving comprises shifting the rollers along the wire without removing the wire from between the rollers.

9. The method of claim 7, including the steps of enclosing said first end of the wire in a protective quill and moving said quill and rollers together toward said first connector while said first end of the wire is enclosed in said protective quill.

10. The method of claim 9 wherein said step of moving said rollers and quill, toward said first connector comprises the step of partly inserting said quill into an aperture of the first connector while said first end of the wire is enclosed in said protective quill and wherein said step of rotating the rollers in a forward direction includes the step of driving the first end of the wire through the protective quill into the first connector.

11. The method of claim 9, wherein said rollers are rotatble in forward and reverse directions about roller axes, and including the step of rotating the rollers and the second end of the wire about an axis parallel to the roller axes to position the second end of the wire adjacent said protective quill, enclosing the second end of the wire in said protective quill, moving the rollers and protective quill into said second connector, and rotating the rollers in reverse direction, thereby driving the second wire end through said protective quill and into said second connector.

12. A method of inserting a wire connected to a terminal into a connector hole, comprising the steps of:

enclosng at least a forward end of the terminal within a protective sheath so that a portion of the wire connected to the terminal extends rearwardly from the protective sheath, and the forward end of the terminal is enclosed within the protective sheath, inserting an end of the protective sheath partly into the connector hole while a forward end of the terminal remains within the protective sheath, and driving the terminal through the protective sheath into the connector hole by driving the wire portion that extends from the protective sheath.

13. The method of claim 12 wherein said step of driving the terminal comprises grasping said terminal between a pair of rollers and rotating the rollers, thereby longitudinally driving the terminal and wire.

14. A method of coupling a wire end to a connector device, comprising the steps of:

mounting a connector device on a support, mounting a pair of juxtaposed rollers on the support for motion toward and away from the connector device, securing first and second terminals to the ends of the wire, mounting an insertion quill on the support for motion relative to the support, positioning the insertion quill adjacent said rollers, grasping the end of the wire between said pair of juxtaposed rollers, inserting the first terminal into the quill while the wire is grasped by the rollers, moving the rollers and the end of the wire together relative to the support and toward the connector device, thereby positioning the end of the wire in a coupling position adjacent said connector device, said step of moving the rollers comprising moving said rollers and quil together, thereby inserting an end of the quill into said connector device, rotating the rollers, thereby driving the end of the wire from the rollers into the connector device for connection therewith, and thereby driving the first terminal through the insertion qill slidably moving the rollers along the wire to the second terminal, grasping the second terminal between the rollers, moving the rollers and second terminal to position the second terminal in a coupling position adjacent a connector device, and rotating the rollers, thereby driving the second terminal from the rollers to said last mentioned connector device for connection therewith.

15. The method of claim 14 wherein said last mentioned connector device includes a second terminal receiving aperture, and including the steps of positioning said insertion quill adjacent said rollers, moving the rollers and second terminal, thereby inserting the second terminal into said quill, said step of moving the rollers and second terminal comprising moving the rollers and quill, thereby inserting an end of said quill into said second terminal receiving aperture.

16. The method of claim 15 wherein the step of moving the rollers and terminal comprises rotating the rollers and terminal about an axis parallel to the axes of said rollers, thereby positioning the second terminal for insertion into said insertion quill.

17. A method of inserting a wire end into a connector aperture, said method comprising the steps of:

mounting a connector having a connector aperture upon a support, mounting a pair of rollers tangentially adjacent each other upon the support for motion relative to the connector, mounting a protective quill upon the support with one end of the quill adjacent the rollers, and for motion with the rollers relative to the support, relatively moving said wire end and rollers and quill axially of the wire and tangentially of the rollers to a position between the rollers and axially aligned with the protective quill, grasping the wire end between the rollers, and rotating the tollers, thereby driving the wire end into the quill and thereby driving the terminal from the quill into the connector aperture.

18. The method of claim 17 including the step of moving said rollers and quill as a unit, with the wire end grasped by the rollers and with the wire end at least partially positioned within and protected by the quill, said step of moving the rollers and quill comprising moving the rollers and quill relative to said support and toward said connector, thereby partly inserting the quill into the connector aperture.

19. The method of claim 17 including the step of moving the quill relative to the wire and rollers in a direction transverse to said wire and then relatively moving the quill and rollers axially of the wire, thereby inserting the wire end into the quill.

20. A method of automatically inserting a terminal that is attached to one end of a wire into a connector, said method comprising the steps of:

mounting a connector upon a support, mounting an insertion head upon the support for motion relative to said connector, mounting a pair of juxtaposed rollers upon the insertion head, mounting a protective insertion quill upon the insertion head adjacent to and for motion with the rollers, moving a terminal attached to a wire along a line that is substantially a common tangent to said rollers and aligned with said protective insertion quill, thereby inserting the terminal and wire between the rollers, grasping the wire between the rollers, moving said insertion head, thereby moving said rollers, said quill, and said grasped wire relative to said connector, thereby positioning said insertion quill adjacent said connector, moving said insertion head, thereby partly inserting an end of said insertion quill into an aperture in said connector, while said end of the insertion quill is partly inserted in the connector, rotating said rollers, thereby driving said terminal through the insertion quill and into said connector for attachment thereto, and after said terminal is attached to said connector, moving said insertion head from the connector, thereby withdrawing said insertion quill from the connector and thereby moving said quill and rollers from the connector.

21. A method of automatically inserting first and second terminals that are attached to ends of a wire into first and second connectors, said method comprising the steps of:

mounting first and second connectors upon a support, mounting an insertion head upon the support for motion relative to said connectors, mounting a pair of juxtaposed rollers upon the insertion head, mounting a protective insertion quill upon the insertion head for motion relative to the rollers, moving the first terminal attached to the wire along a line that is substantially a common tangent to said rollers, thereby inserting the first terminal between the rollers, grasping the first terminal between the rollers, moving said insertion head relative to said first connector, thereby positioning said insertion quill adjacent said first connector, moving said insertion head, thereby partly inserting an end of said insertion quill into an aperture in said connector, while said end of the insertion quill is partly inserted in the connector, rotating said rollers, thereby driving said first terminal through the insertion quill and into said first connector for attachment thereto, and after said first terminal is attached to said first connector, moving said insertion head, thereby withdrawing said insertion quill from the first connector and thereby moving said quill and rollers from the first connector, displacing said quill from said wire while said wire remains captured between said rollers, moving said insertion head relative to said support toward said second connector and along said wire until said second terminal is positioned between said rollers, said rollers having mutually parallel and mutually displaced rotation axes, rotating said rollers about a common axis parallel to said rotation axes, relatively moving said insertion quill and rollers, thereby inserting said second terminal into said insertion quill, moving said insertion head relative to said second connector, thereby inserting an end of said insertion quill partly into said second connector, and rotating said rollers in a reverse direction, thereby driving said second terminal through said insertion quill and into said second connector.

22. A method of coupling a wire end to a connector device, comprising the steps of:

mounting a connector device on a support, mounting a pair of juxtaposed rollers on the support for motion toward and away from the connector device, grasping the end of the wire between said pair of juxtaposed rollers, mounting an insertion quill on the support for motion with and adjacent the rollers, enclosing the end of the wire within the insertion quill, thereby protecting the end of the wire while the rollers and the end of the wire move toward the connector device, moving the rollers and the end of the wire together relative to the support and toward the connector device, thereby positioning the end of the wire in a coupling position adjacent said connector device, said step of moving the rollers comprising positioning the quill with the enclosed wire end at the connector device, rotating the rollers, thereby driving the end of the wire from the rollers into the connector device for connection therewith, said step of rotating the rollers including driving the end of the wire from the quill into the connector device.

* * * * *

UNITED STATES PATENT AND TRADEMARK OFFICE

CERTIFICATE OF CORRECTION

PATENT NO. : 4,658,503

DATED : April 21, 1987

INVENTOR(S) : HOMER L. EATON

It is certified that error appears in the above-identified patent and that said Letters Patent is hereby corrected as shown below:

Claim 11 (column 15, line 35), delete "rotatble" and substitute therefor —rotatable—.

Claim 14 (column 16, line 13), delete "quil", and substitute therefor —quill—.

Claim 14 (column 16, line 18), delete "qill", and substitute therefor —quill—.

Claim 17 (column 16, line 58) delete "tollers", and substitute therefor —rollers—.

Signed and Sealed this

Eleventh Day of August, 1987

*Attest:*

DONALD J. QUIGG

*Attesting Officer*

*Commissioner of Patents and Trademarks*